US006931793B2

(12) United States Patent
Joyce et al.

(10) Patent No.: US 6,931,793 B2
(45) Date of Patent: Aug. 23, 2005

(54) ROOF SCUTTLE SAFETY RAILING SYSTEM

(75) Inventors: Roger F. Joyce, Guilford, CT (US); Donald Barker, Sandy Hook, CT (US); Kenneth R. Gleason, Woodbridge, CT (US); James G. Gleason, Stratford, CT (US)

(73) Assignee: The Bilco Company, West Haven, CT (US)

( * ) Notice: Subject to any disclaimer, the term of this patent is extended or adjusted under 35 U.S.C. 154(b) by 77 days.

(21) Appl. No.: 10/359,938

(22) Filed: Feb. 6, 2003

(65) Prior Publication Data

US 2004/0154241 A1 Aug. 12, 2004

(51) Int. Cl.[7] ..... E02D 29/14

(52) U.S. Cl. ..... 52/20; 182/112; 256/65.14; 256/DIG. 6

(58) Field of Search ..... 52/20, 200; 182/106, 182/112, 113; 256/65.14, DIG. 6

(56) References Cited

U.S. PATENT DOCUMENTS

| | | | | | |
|---|---|---|---|---|---|
| 3,881,698 | A | * | 5/1975 | Marsh | 256/59 |
| 3,995,833 | A | * | 12/1976 | McLaughlin et al. | 256/59 |
| 4,520,898 | A | * | 6/1985 | Allemane | 182/113 |
| 4,546,855 | A | | 10/1985 | Lyons | |
| 4,729,453 | A | | 3/1988 | Lyons, Sr. | |
| 4,781,008 | A | | 11/1988 | Lyons, Jr. | |
| 4,941,300 | A | | 7/1990 | Lyons, Jr. | |
| 5,842,685 | A | | 12/1998 | Purvis et al. | |
| 5,941,024 | A | * | 8/1999 | Journault | 52/20 |
| 5,960,596 | A | | 10/1999 | Lyons, Sr. | |
| 6,053,281 | A | * | 4/2000 | Murray | 182/113 |
| 6,167,659 | B1 | | 1/2001 | Swindell, III | |
| 6,272,800 | B1 | * | 8/2001 | Phinney et al. | 52/200 |
| 6,467,230 | B1 | * | 10/2002 | Perkins et al. | 52/655.1 |
| 6,585,080 | B2 | * | 7/2003 | Murray | 182/45 |
| 6,672,020 | B1 | * | 1/2004 | Cermola et al. | 52/200 |
| 6,688,046 | B2 | * | 2/2004 | Perkins | 52/19 |
| 2002/0124786 | A1 | * | 9/2002 | Perkins | 114/201 R |

OTHER PUBLICATIONS

*Hatchguard™ Safety Rail System*, J. L. Industries, Inc., http//www.jlindustries.com/products/roofacc/saf–t–rail/hatchguard.htm, p. 1 of 1, Apr. 2, 2003.

*Model RHA Aluminum Hatch*, J. L. Industries, Inc., http//www.jlindustries.com/products/roofacc/roofhatches/aluminum.htm, pp. 1 and 2, Apr. 2, 2003.

* cited by examiner

*Primary Examiner*—Korie Chan
(74) *Attorney, Agent, or Firm*—DeLio & Peterson, LLC

(57) ABSTRACT

A roof scuttle safety railing system is provided for an existing or new roof scuttle which railing may be installed on the roof scuttle by unskilled labor without compromising the integrity of the weather seal of the roof scuttle. In one embodiment, pivotal corner brackets are secured to the capflashing of a roof scuttle with the vertical members of the safety railing being inserted in openings in the brackets. In another embodiment, an elongated bracket is used along two opposed sides of the roof scuttle which brackets are firmly held against the outside walls of the roof scuttle by tie rods, a strap or a cable. The elongated bracket has vertical openings at its distal ends for securing the vertical members of the safety railing and horizontal openings or slots for the tie rods, straps or cables. A hinged gate is also provided which preferably has a self-closing hinge.

12 Claims, 11 Drawing Sheets

ROOF SCUTTLE SAFETY RAILING SYSTEM

BACKGROUND OF THE INVENTION

1. Field of the Invention

This invention relates to horizontal hinged door assemblies such as roof scuttles and, in particular, to a safety railing which may easily be installed on new and existing roof scuttles by unskilled labor without compromising the integrity of the weather seal of the roof scuttle.

2. Description of Related Art

Horizontal hinged (covers) doors are commonly used for roof scuttles, automatic fire vents, ceiling access doors, basement doors and other access doors. The present invention will be directed for convenience to single door roof scuttles which are used to provide access to a roof but it will be appreciated to those skilled in the art that the invention is applicable to other horizontal hinged doors such as double leaf roof scuttles for which a safety railing around the door is desired.

Roof scuttles are ruggedly built for long, dependable service and generally comprise a rectangular frame extending above the roofline and which surrounds the opening to be covered. A door is hinged to the frame for motion of the door between an open and closed position The conventional roof scuttle has a vertical sheet metal inner wall with an outwardly extending 90° horizontal anchoring flange at the bottom of the wall, which flange is nailed or otherwise secured to the roof deck through holes provided in the flange. Rigid fiberboard insulation extends around the inner wall and forms the outer wall of the frame. A capflashing is connected to the top of the inner wall usually by welding and extends downward over the top portion of the outer wall. Roofing materials are then used to waterproof the outer wall of the frame typically by rolling the roofing along the roof surface and then up the vertical outer walls (curb) of the frame and securing the roofing material to the curb. When the roofing material is secured a weather resistant installation is complete.

Securing the roofing material to the roof scuttle frame requires experienced and skilled labor to properly waterproof the scuttle. A number of patents have issued in this area relating to forming a waterproof seal between a waterproof roofing material and the scuttle frame surrounding a roof opening. In U.S. Pat. No. 5,960,596, a roofing device is shown for sealing the roofing material to a roof scuttle having a curb wherein the roofing material is wrapped over an elongated resilient filler piece which is snuggly inserted into a filler channel between the wall and a top flange of the capflashing of the scuttle. A conventional roof scuttle of the prior art is shown schematically herein in FIG. 1 wherein the inner wall 19 of the roof scuttle is bent 90° to form a base flange 23 which may be adhesively sealed and nailed or screwed in a conventional manner to the roof through openings 23*a*. The roof surface and outer wall curb 18*a* of the roof scuttle are covered with a roofing material which is then secured in place against the outer wall 18*a*. Another similar sealing system for a conventional roof scuttle is shown in U.S. Pat. No. 4,941,300. In U.S. Pat. No. 4,781,008 a frame assembly is shown for surrounding an opening in a building surface and for securing a waterproof roofing material to the frame assembly. All the above patents are hereby incorporated by reference.

Use of a roof scuttle necessarily leaves an opening in the roof when the door of the roof scuttle is open as shown in FIG. 1.

Bearing in mind the problems and deficiencies of the prior art, it is one object of the present invention to provide a roof scuttle for enclosing a roof opening which roof scuttle has a safety railing attached thereto which is easily installed by unskilled labor on any size new or existing roof scuttle without compromising the integrity of the weather seal of the roof scuttle.

It is another object of the present invention to provide methods for installing a safety railing on a new or existing roof scuttle without compromising the integrity of the weather seal, which methods are easily performed by unskilled labor.

Still other objects and advantages of the invention will in part be obvious and will in part be apparent from the specification.

SUMMARY OF THE INVENTION

The above and other objects, which will be apparent to those skilled in art, are achieved in the present invention which relates in one aspect to a roof scuttle and safety railing system for enclosing a roof opening comprising:

a rectangular roof scuttle having a vertical curb extending upward from the roof surface and extending around the periphery of an opening in the roof, the vertical curb having front, rear and opposed sides, a door hinged to the scuttle for moving to an open or closed position and a capflashing on the top of the curb which has a horizontal member extending outward from the curb and at least one vertical member extending downward toward the roof surface with a space between the outside wall of the curb and the inside wall of the vertical member, the capflashing extending around the periphery of the curb;

two pairs of brackets secured to the vertical member of the capflashing with each bracket proximate each corner of the scuttle, each pair of brackets having at least one bracket which is pivotable laterally about a vertical axis and preferably having a vertically disposed pivot pin plug spaced away from the vertical member and one or more arms pivotally mounted thereto, each arm having at least one vertically spaced opening for holding and securing a vertical member of a safety railing and the other bracket of each pair also being pivotable or fixed extending outward from the vertical member and having at least one vertically spaced opening therein for holding and securing the other vertical member of the safety railing;

one or more safety railings, each railing having two vertical members and one or more horizontal connected cross members running between the two vertical members with each vertical member being held and secured in a bracket opening; and optionally a gate hingedly connected at the front side of the roof scuttle to one of the safety railing vertical members for movement to and away from the roof opening.

Another aspect of the invention is a roof scuttle and a safety railing system for enclosing a roof opening comprising:

a roof scuttle having a vertical curb extending upward from the roof surface and extending around the periphery of an opening in the roof having front, rear and opposed sides and a door hinged to the scuttle for moving the door to an open or closed position;

opposed elongated brackets, preferably channel shaped, running either along the front and rear sides or the opposed sides and having their distal ends extending outward from each edge of the curb, each end of the brackets having at least one vertically spaced through opening to hold and secure a vertical member of a safety railing and one or more horizontal through openings away from the edge of the curb; and one or more elongated tie rods running along each side of the curb not having a bracket, the ends of each rod passing through the horizontal through openings and being fastened to the brackets holding the brackets firmly against the vertical curb; and one or more safety railings each railing having two vertical members and one or more horizontal connected cross members running between the two vertical members with each vertical member being held and secured in a bracket vertical opening; and optionally a gate hingedly connected at the front side of the roof scuttle to one of the safety railing vertical members for movement to and away from the roof opening.

In another aspect of the invention a roof scuttle and safety railing system for enclosing a roof opening is provided comprising:

a roof scuttle having a vertical curb extending upward from the roof surface and extending around the periphery of an opening in the roof having front, rear and opposed sides and a door hinged to the scuttle for moving the door to an open or closed position;

opposed elongated brackets, preferably channel shaped, running either along the front and rear curb or the opposed sides and having their distal ends extending outward from the edge of the curb each edge of the bracket having at least one vertically spaced through opening to hold and secure a vertical member of a safety railing and one or more horizontal through openings away from the edge of the curb; and a flexible strap or cable running around the periphery of the curb and passing through the horizontal openings in the brackets, which strap or cable is fastened to hold the brackets firmly against the side of the curb; and one or more safety railings each railing having two vertical members and one or more horizontal connected cross members running between the two vertical members with each vertical member being held and secured in a bracket vertical opening; and optionally a gate hingedly connected at the front side of the roof scuttle to one of the safety railing vertical members for movement to and away from the roof opening.

In another aspect of the invention, a method is provided for installing a safety railing on a new or existing roof scuttle used to cover a roof opening comprising the steps of:

providing a roof scuttle surrounding a roof opening, which scuttle has a vertical curb extending upward from the roof surface and extending around the periphery of the opening in the roof, the vertical curb having front, rear and opposed sides and the scuttle is weather proofed and installed on the roof, the roof scuttle having a capflashing on the top of the curb having a horizontal member extending outward form the curb and at least one vertical member extending downward toward the roof surface with a space between the outside wall of the curb and the inside wall of the vertical member, the capflashing extending around the periphery of the curb;

securing two pairs of brackets to the vertical member of the capflashing with each bracket proximate each corner of the scuttle, each pair of brackets having at least one bracket which is pivotable laterally about a vertical axis and preferably having a vertically disposed pivot pin plug away from the vertical member and one or more arms pivotally mounted thereto, each arm having at least one vertically spaced opening for holding and securing a vertical member of a safety railing and the other bracket of each pair also being pivotable or fixed extending outward from the vertical member and having at least one vertically spaced opening therein for holding and securing the other vertical member of the safety railing;

providing one or more safety railings each railing comprising two spaced apart vertical members and connecting cross members;

inserting the vertical members of each safety railing into the vertical bracket openings on the opposed sides of the scuttle; and optionally providing a gate hingedly connected to at the front side of the roof scuttle to one of the vertical members of the safety railing for movement to and away from the roof opening;

securing each vertical member in each vertical bracket opening.

In a further aspect of the invention a method is provided for installing a safety railing on a new or existing roof scuttle used to cover a roof opening comprising the steps of:

providing a roof scuttle having a vertical curb extending upward from the roof surface and extending around the periphery of an opening in the roof having front, rear and opposed sides and a door hinged to the scuttle for moving the door to an open or closed position;

positioning opposed elongated brackets, preferably channel shaped, running either along the front and rear sides of the curb or the opposed sides of the curb, which brackets have their distal ends extending outward from the edge of the curb, each end of the brackets having at least one vertically spaced opening to hold and secure a vertical member of a safety railing and having one or more horizontal through openings away from the edge of the curb; and securing one or more tie rods running along the sides of the curb not having the brackets, the ends of each rod passing through the horizontal openings and fastened to the brackets holding the brackets firmly against the vertical curb;

one or more safety railings each railing having two vertical members and one or more horizontal connected cross members running between the two vertical members with each vertical member being held and secured in a vertical bracket opening; and optionally a gate hingedly connected at the front side of the roof scuttle to one of the safety railing vertical members for movement to and away from the roof opening.

In another aspect of the invention a method is provided for installing a safety railing on a new or existing roof scuttle comprising the steps of:

providing a roof scuttle having a vertical curb extending upward from the roof surface and extending around the periphery of an opening in the roof having front, rear and opposed sides and a door hinged to the scuttle for moving the door to an open or closed position;

positioning opposed elongated brackets, preferably channel shaped, running either along the front and rear sides of the curb or the opposed sides of the curb, which brackets have their distal ends extending outward from the edge of the curb, each end of the brackets having at least one vertically spaced openings to hold and secure a vertical member of a safety railing and having one or more horizontal through openings away from the edge of the curb; and running a flexible strap or cable around the periphery of the curb through each of the horizontal bracket openings and then fastening the strap or cable together to hold the brackets firmly against the sides of the curb;

one or more safety railings each railing having two vertical members and one or more horizontal connected cross members running between the two vertical members with each vertical member being held and secured in a bracket opening; and optionally a gate hingedly connected at the front side of the roof scuttle to one of the safety railing vertical members for movement to and away from the roof opening.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENTS

In describing the preferred embodiment of the present invention, reference will be made herein to FIGS. 1–8 of the drawings in which like numerals refer to like features of the invention.

Figure 1:
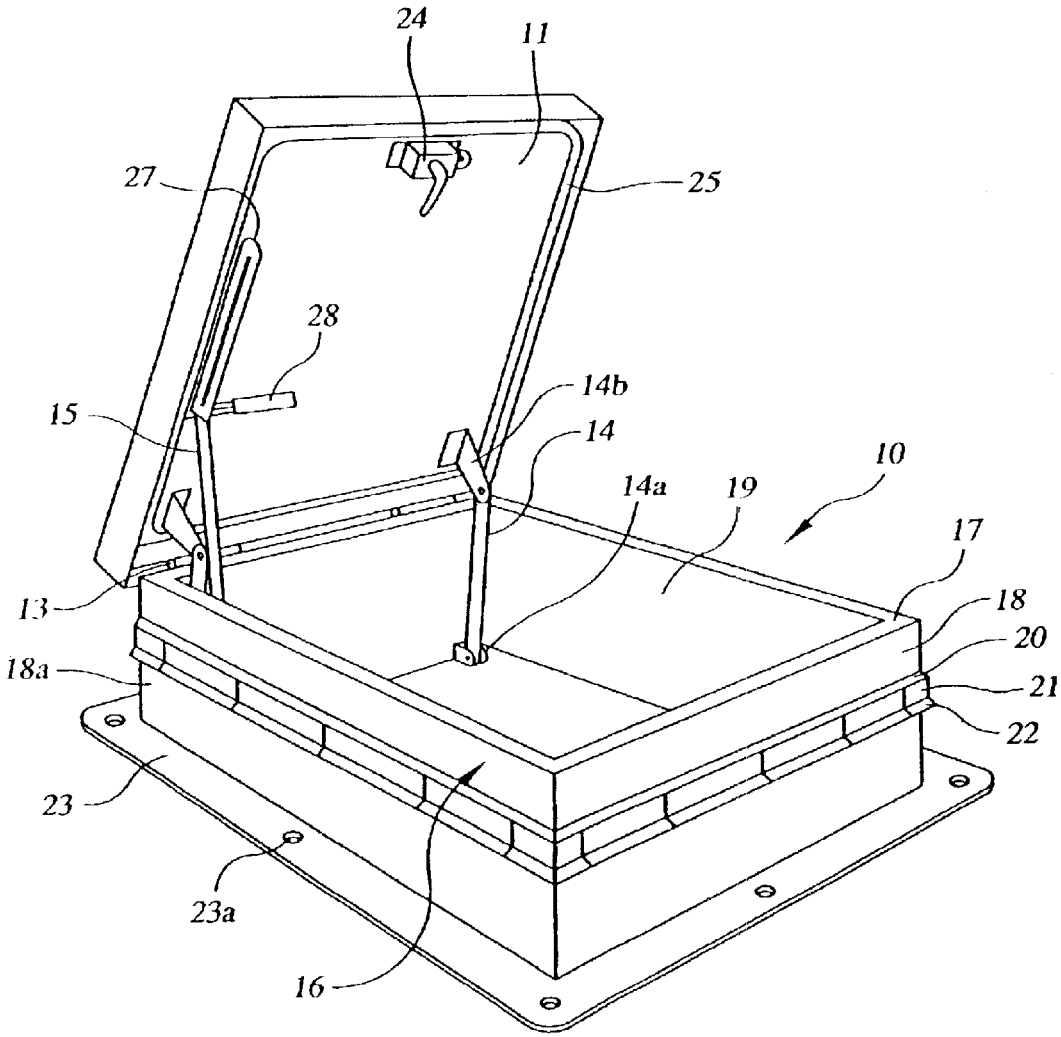
FIG. 1 (PRIOR ART)
FIG. 1 is a perspective view of a roof scuttle of the prior art.

Referring to FIG. 1, a roof scuttle of the prior art without a safety railing is shown generally as 10. The scuttle has a cover or door 11 which is hinged by hinge 13 to the roof scuttle frame shown generally as 12. The roof scuttle frame 12 comprises a vertical outer wall 18*a*, and a vertical inner wall 19. The frame has a top capflashing shown generally as 16 having a top horizontal curb 17. The scuttle also has a spring lift mechanism 14 rotably held by a bracket 14*a* to the inner frame wall 19 and by bracket 14*b* to the door 11 to facilitate opening and closing of the roof door. A rotatable support strut shown as 15 engages L-slot 27 during opening and closing of the door and maintains the roof door of the scuttle in an open position until it is desired to close the roof scuttle door. A door handle is shown as 28. Also shown is a lock 24 and gasket 25 which travels around the door and sits on top curb 17 to seal the door when closed.

The capflashing 16 is an integral structure comprising a horizontal top curb 17 having an inner lip 17*a* (not shown), vertical upper outer wall 18, an angular flange 20 which is connected to a vertical flange 21 and which ends in a downwardly outwardly extending drip edge flange 22. The roof scuttle has an outside curb 18*a* ending at nailing flange 23 (with nail openings 23*a*) which nailing flange is formed by bending the inner wall 19 90° at the lower end. The curb 18*a* is typically rigid fiberboard insulation and the inner wall 19 sheet metal generally about ⅛ inch thick. The lip 17*a* of the capflashing is typically welded to the inner frame wall 19 to secure the capflashing to the door assembly. The capflashing is made from sheet metal and is generally about ⅛ inch thick.

Figure 2:
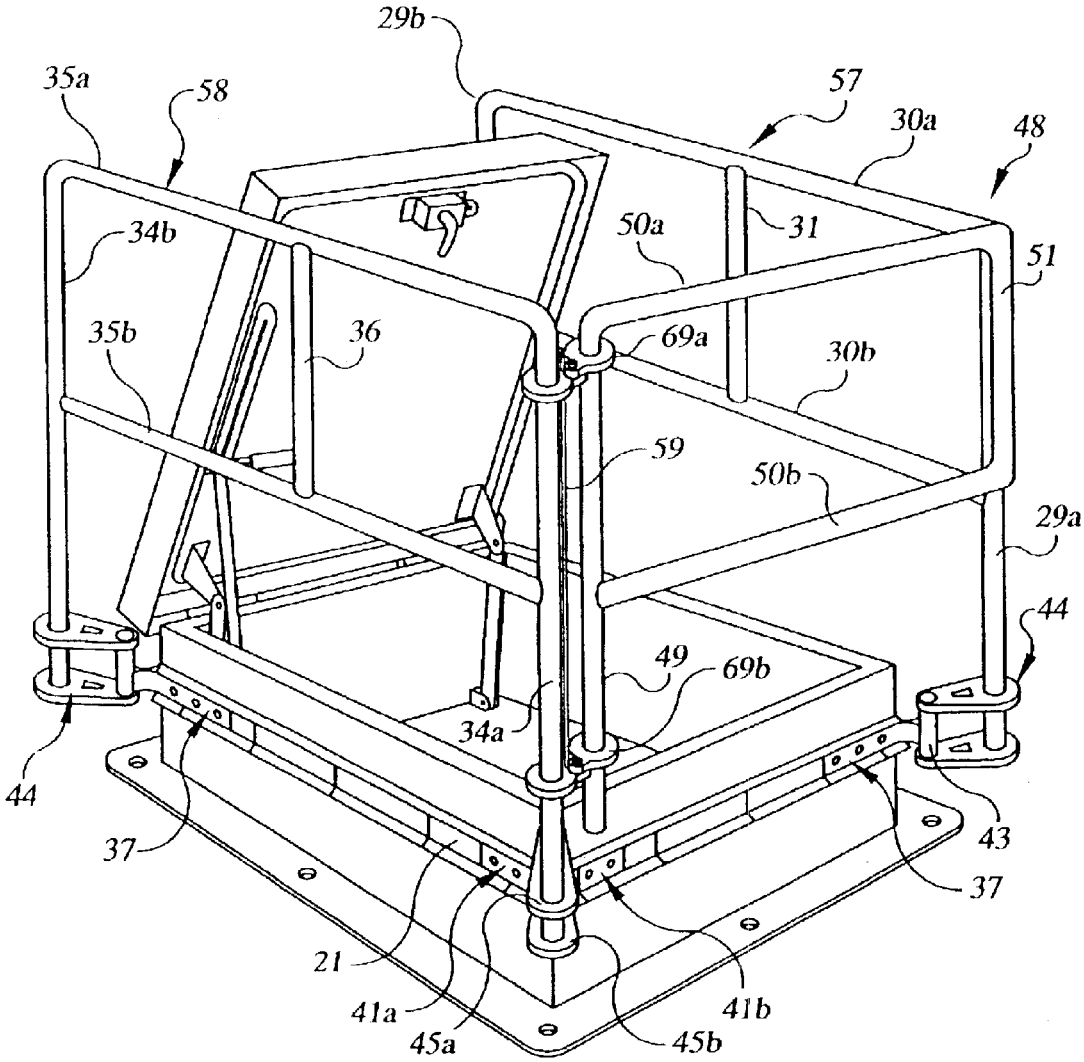
FIG. 2 is a perspective view of a roof scuttle and safety railing system of one aspect of the invention using pivotal brackets.

Referring now to FIG. 2, the roof scuttle of FIG. 1 is shown having a safety railing system of the invention. Pivotable brackets 37 are shown at the corners of the roof scuttle and comprise transverse arms 41*a* and 41*b* which are attached to vertical member 21 of the capflashing by appropriate fasteners such as bolts. The bracket 37 has a pivot plug 43 disposed vertically. Two swivel brackets 45*a* and 45*b* are pivotally attached to the plug 43 and have openings in which the vertical members of the safety railing are inserted and secured. It can be seen that left railing vertical members 34*a* and 34*b* are inserted into their respective bracket openings and right railing vertical members 29*a* and 29*b* are inserted into their respective bracket openings. The right safety railing has cross members 30*a* and 30*b* and a central support 31. The left safety railing has cross members 35*a* and 35*b* and a central support 36. A gate 48 is shown hingedly connected to left safety railing vertical member 34*a*. The gate comprises a vertical member 49 which is hingedly connected to vertical member 34*a* by hinges 69*a* and 69*b*. As shown in FIG. 2, a torsion bar 59 is used to form a self-closing force for the gate. When the gate is swung outward from the roof scuttle opening, the torsion bar is rotated (twisted) creating a force which will return the gate to its original position after the opening force is released. The gate 48 comprises cross members 50*a* and 50*b* and connected vertical member 51.

Any self-closing hinge may be used for the gate of the roof scuttle of the invention. A helix hinge can be used whereby the offset hinge mechanism elevates the center of gravity of the gate during opening and likewise provides for the automatic return of the gate to the closed position.

Figure 3:
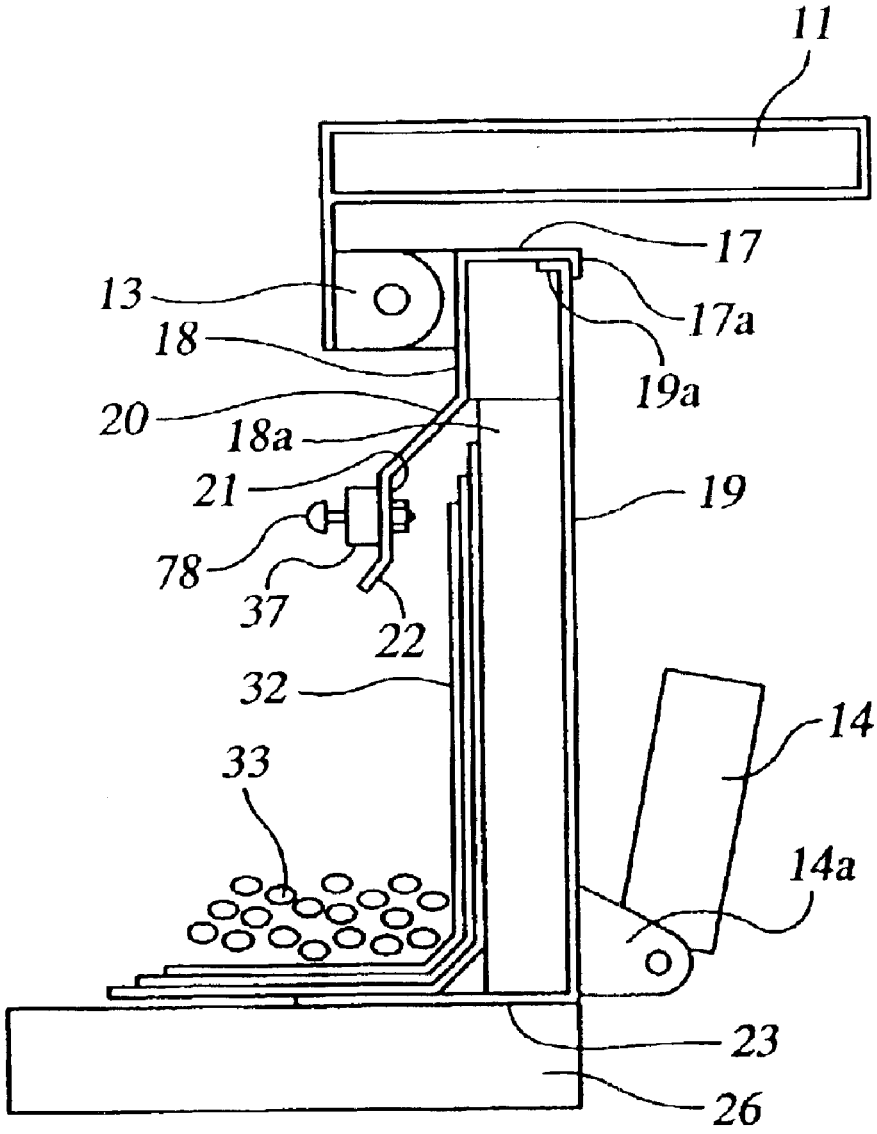
FIG. 3 is a schematic elevational view of a curb and a door of a roof scuttle having a vertically pivotal bracket secured to the capflashing of the roof scuttle.

Referring now to FIG. 3, the roof scuttle comprises an inner wall 19 with an upper inward lip 19*a*. Inner wall 19 has a 90° bend at the lower end thereof to form an anchoring flange 23. The upper portion of the roof scuttle has a capflashing 16 comprising horizontal curb 17 and downward lip 17*a*, an upper vertical outer wall 18, angled flange wall 20, vertical wall 21 and drip edge flange 22. A curb 18*a* completes the frame. A hinge 13 connects the frame to the door 11 and a spring lift mechanism 14 is shown rotably connected to inner wall 19*a* by bracket 14*a*. The roof scuttle is shown installed on a roof wherein the anchoring flange 23 is secured to roof 26. Three sheets of roofing material shown in composite as 32 are laid on the roof and the outer wall 18*a* of the frame to seal the frame. Ballast 33 is shown as part of the roofing material. An elongated filler piece (not shown) may be used to hold the roofing material as described in U.S. Pat. No. 5,960,596, supra. It should be appreciated that the installation of this type roof scuttle requires a skilled worker to properly apply the roofing material to waterproof the scuttle.

Figure 4:
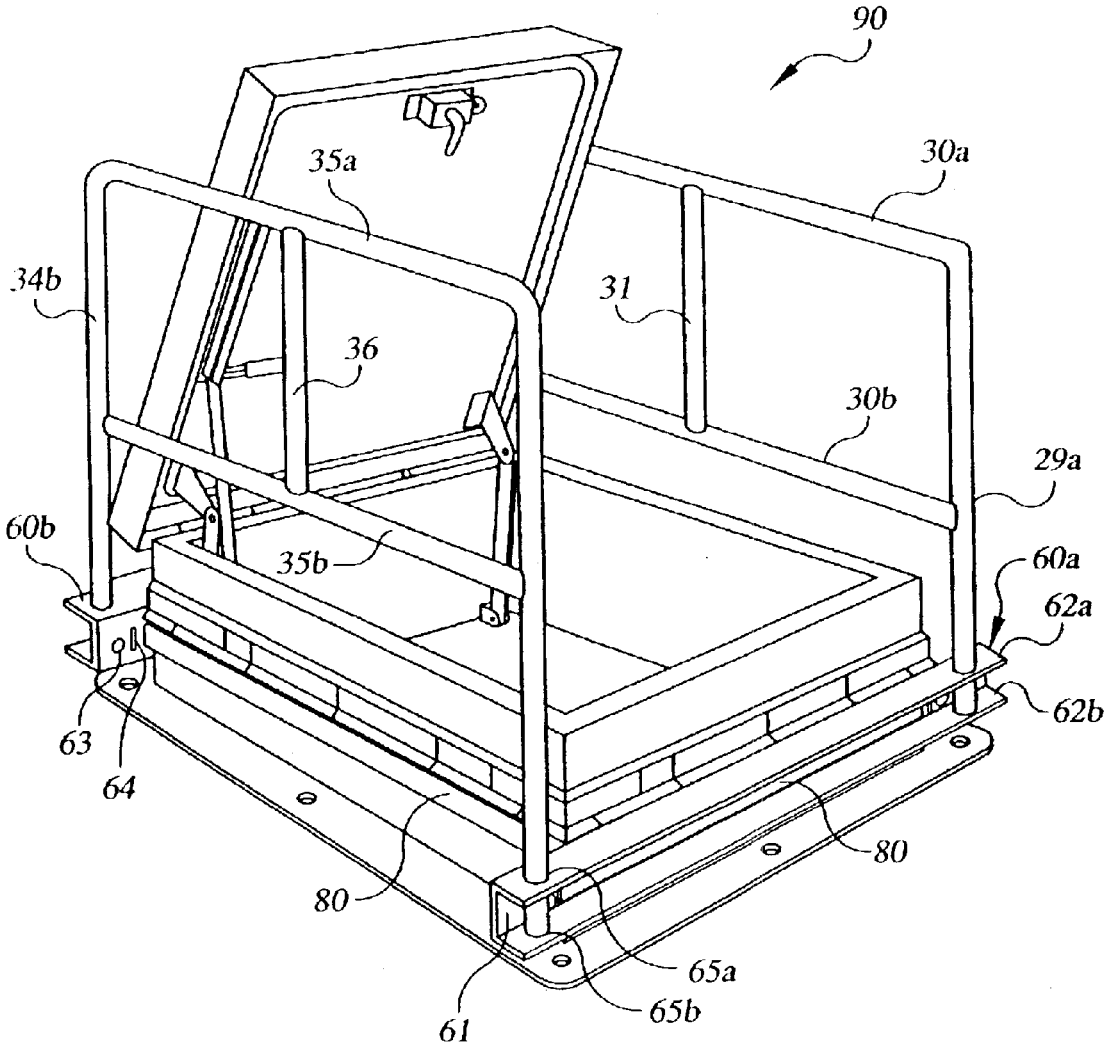
FIG. 4 is a perspective view of a roof scuttle and safety railing system of another aspect of the invention using a flexible strap to secure safety railing mounting brackets to the scuttle curb.
Figure 6:
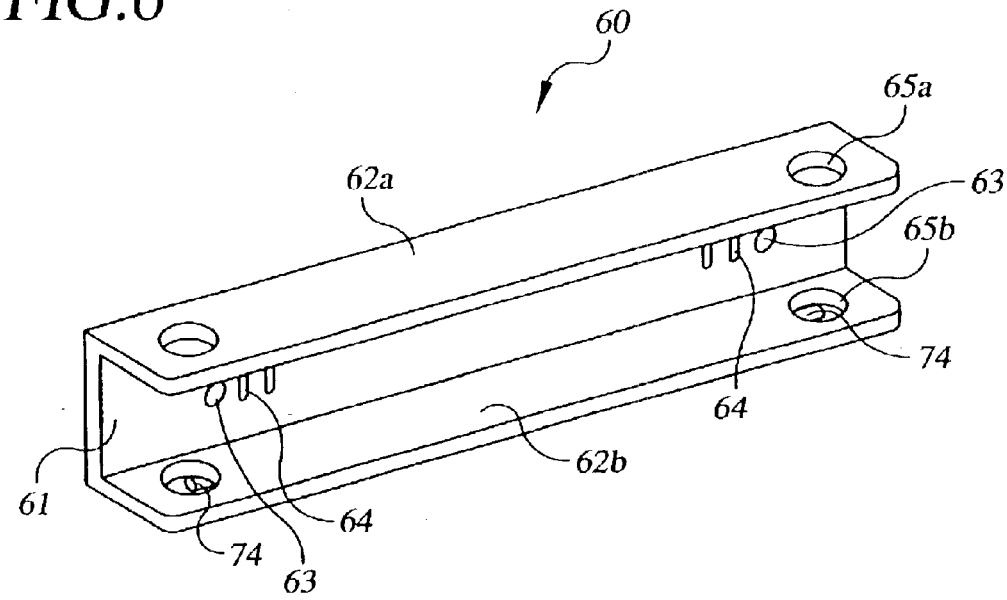
FIG. 6 is a perspective view of a safety railing mounting bracket used in the invention as shown in FIGS. 4 and 5.

Referring now to FIGS. 4 and 6, a roof scuttle safety railing system is shown generally as 90. An elongated bracket 60*a* and an opposing elongated bracket 60*b* are positioned at the front and rear sides of the curb. The brackets have a channel shape and have an elongated body portion 61 which is slightly longer than the side of the curb and transverse arm portions 62*a* and 62*b*. The base has one or more horizontal openings 63 to accommodate connecting tie rods and horizontal openings 64 for straps to be passed through. The arms 62*a* and 62*b* have vertical spaced openings 65*a* and 65*b* to hold and secure the vertical members of the safety railing.

Right safety railing vertical members 29*a* and 29*b* and left safety rail vertical members 34*a* and 34*b* are positioned in their respective bracket openings 65*a* and 65*b*. The right safety railing has cross members 30*a* and 30*b* and a central vertical support 31. The left safety railing has cross members 35*a* and 35*b* and central support 36. The gate 48 of FIG. 2 is not shown for clarity but would be connected to the railing as described above. A strap 80 is passed through the horizontal openings 64 in the elongated brackets 60*a* and 60*b* and extends around the periphery of the roof scuttle curb. The strap is tightened and locked and holds the two elongated brackets 60*a* and 60*b* against the front and rear sides of the roof scuttle and secures the vertical members of the railing system.

Figure 5:
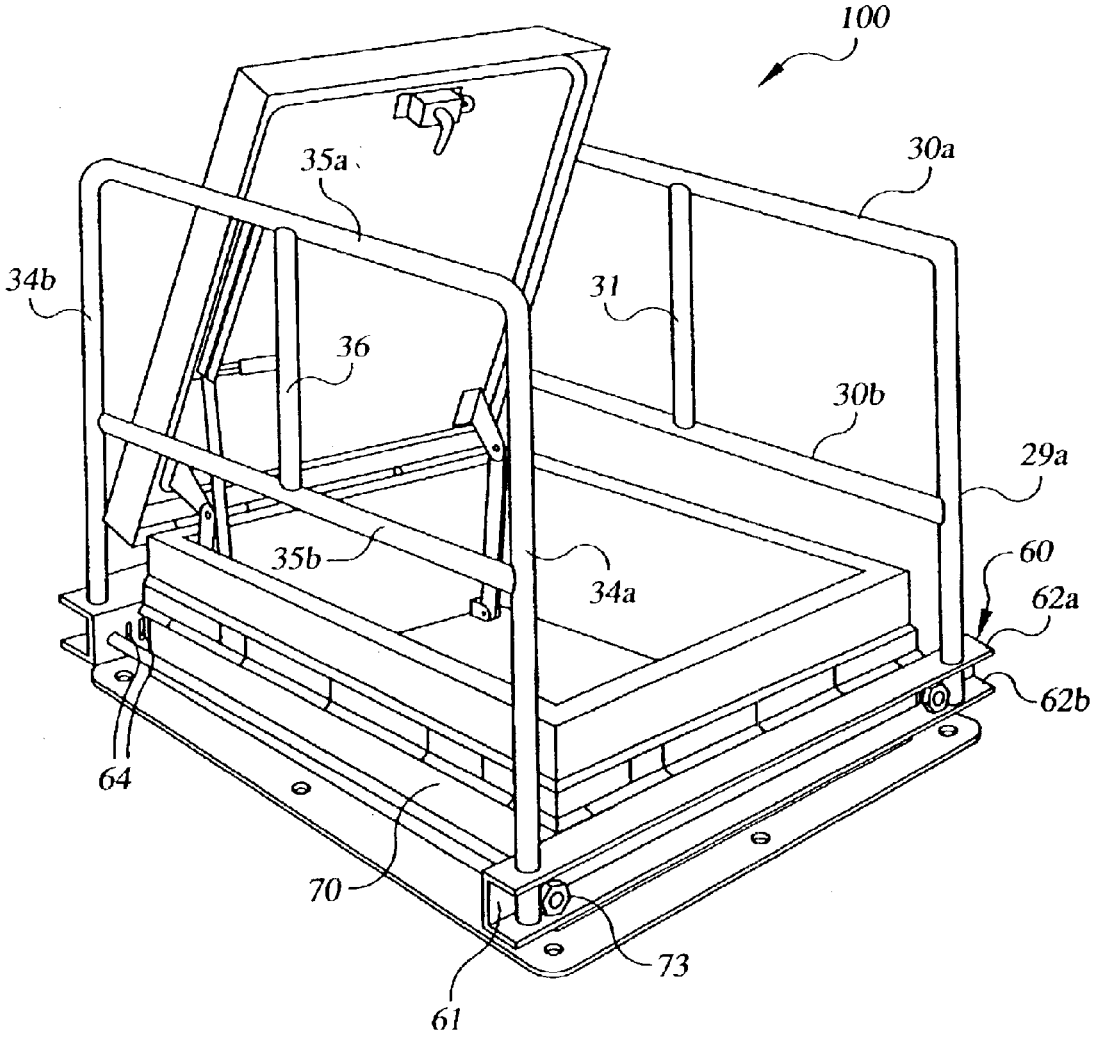
FIG. 5 is a perspective view of a roof scuttle and safety railing system of another aspect of the invention using tie rods to secure safety railing mounting brackets to the scuttle curb.

Referring now to FIG. 5, a roof scuttle railing system (shown generally as 100) similar to that in FIG. 4 is shown except that tie rods 70 are used to hold the front and rear elongated brackets 60*a* and 60*b* firmly against the side of the curb. The ends of the tie rod are preferably threaded and a nut 73 is used to secure the tie rod to the bracket. As in FIG. 4, the gate is not shown for clarity.

Referring now to FIG. 6, the elongated bracket 60 is shown in detail. The bracket is a channel shape and has an elongated flat base 61 and transverse arms 62*a* and 62*b*. The base 61 has horizontal tie rod openings 63 at each end thereof and one or more horizontal strap hole openings (shown as slots) 64 proximate the tie rods openings. The elongated bracket also has vertically axially spaced through openings in the arms 62*a* and 62*b* shown as 65*a* and 65*b*. As noted above the vertical support members of the safety railing are inserted into openings 65*a* and 65*b* to secure the railing to the brackets. All the openings in the bracket are away from the edge of the curb so that the tie rods and straps can pass through and the vertical members of the safety railing have clearance for opening and closing the door. A stop 74 is disposed under opening 65*b* to support the vertical railing member.

Figure 7A:
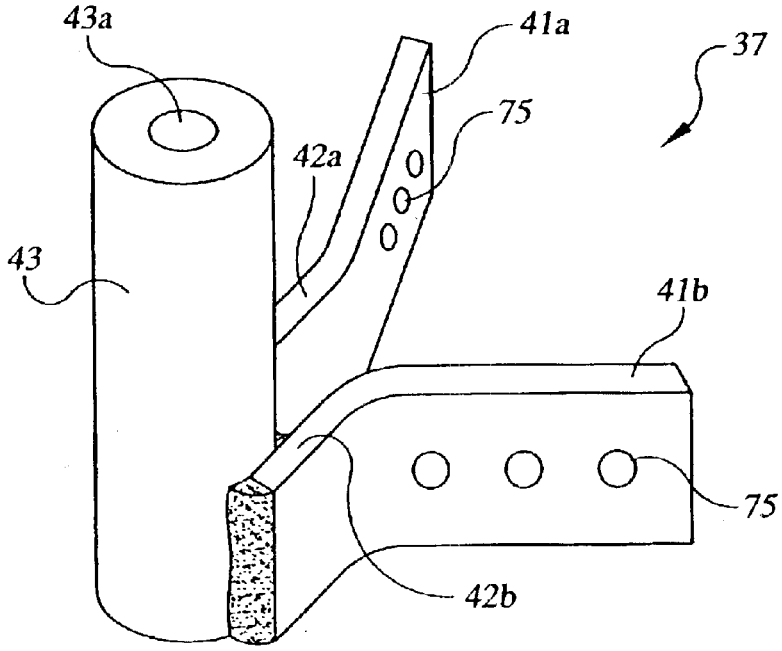
FIG. 7A is a perspective view of part of a pivotal bracket used in the invention.
Figure 7B:
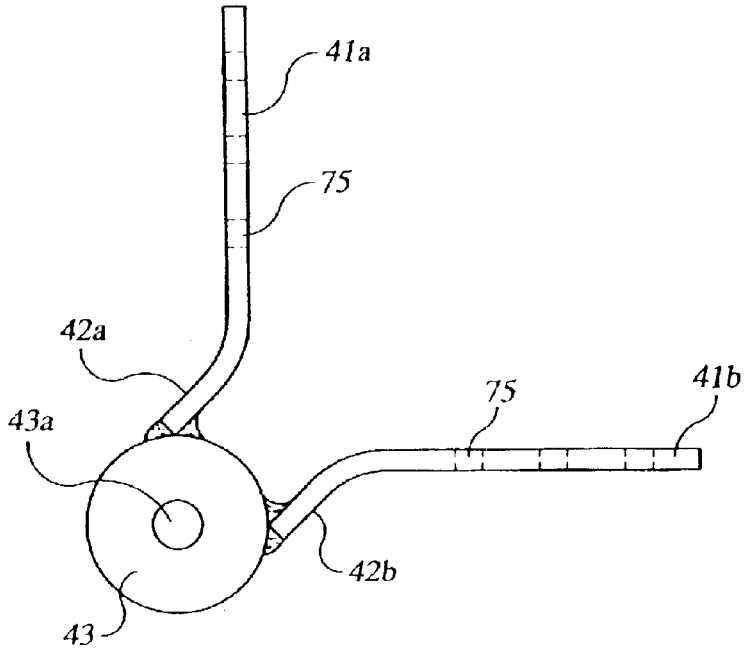
FIG. 7B is a plan view of the bracket of FIG. 7A.

Referring now to FIG. 7A, one part of a preferred pivotal bracket used in the invention is shown generally as 37. The bracket comprises transverse arms 41*a* and 41*b* which are bent angularly outward (42*a* and 42*b*) to accommodate a pivot pin plug 43 which is welded or otherwise secured at the ends of 42*a* and 42*b*. A through opening 43*a* is provided in the plug 43 to accommodate a pivot pin. Openings 75 are provided for receiving the bracket to the capflashing. A plan view of the bracket is shown in FIG. 7B.

Figure 7C:
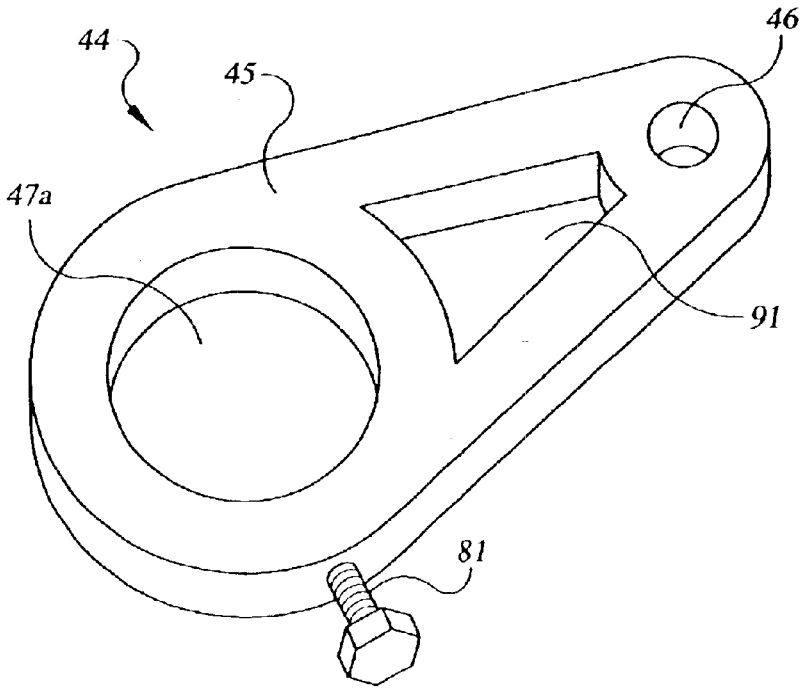
FIG. 7C is a perspective view of a flange member used in conjunction with the bracket of FIG. 7A.

A swivel bracket member shown in FIG. 7C generally as 44 comprises a flat oval shaped bracket body 45 having a through opening 47*a* therein to accommodate a vertical safety rail member. The bracket body 45 also has an opening 91 and has a through opening 46 to accommodate a pivot pin. A set screw 81 is used to secure the safety railing member in the opening.

Figure 7D:
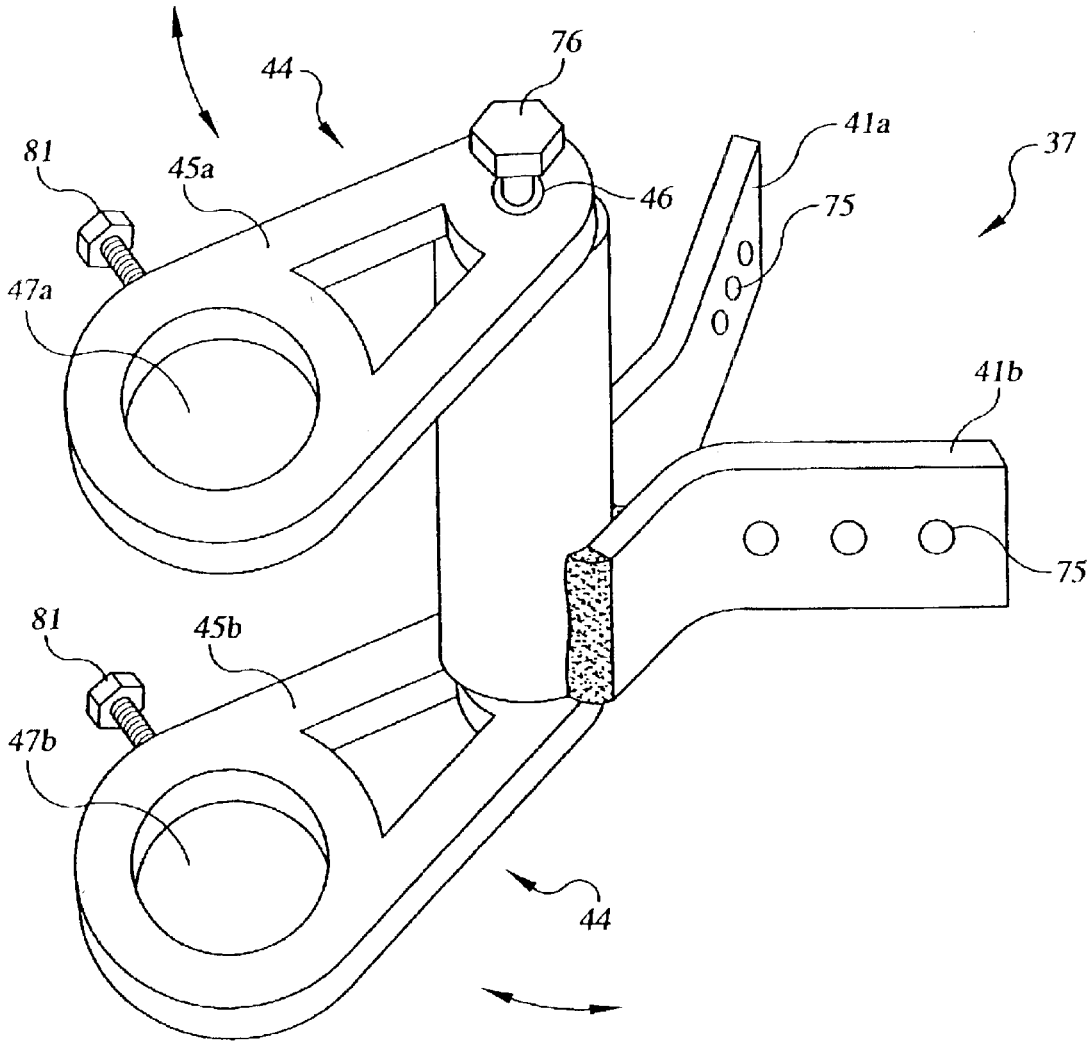
FIG. 7D is a perspective view of the assembled bracket using the components of FIGS. 7A and 7C.

In use, as shown in FIG. 7D, the opening 46 in the swivel bracket member 44 is mated with the opening 43*a* of the bracket. A pivot pin 76 would then be inserted through both openings so that the swivel portion 44 can swing laterally about a vertical axis as shown by the arrows. This lateral movement allows for the use of different length safety railings and/or the ease of installing the safety railing since dimensional variations of the curb can be accommodated by swiveling the bracket. Two swivel bracket members 45*a* and 45*b* are preferably used to provide additional stability to the railing vertical members. A locking screw 81 is also preferably used to secure the railing in the opening. When the railing is inserted and secured in the bracket openings the swivel bracket members 45*a* and 45*b* are secured by tightening the pivot pin.

Figure 8:
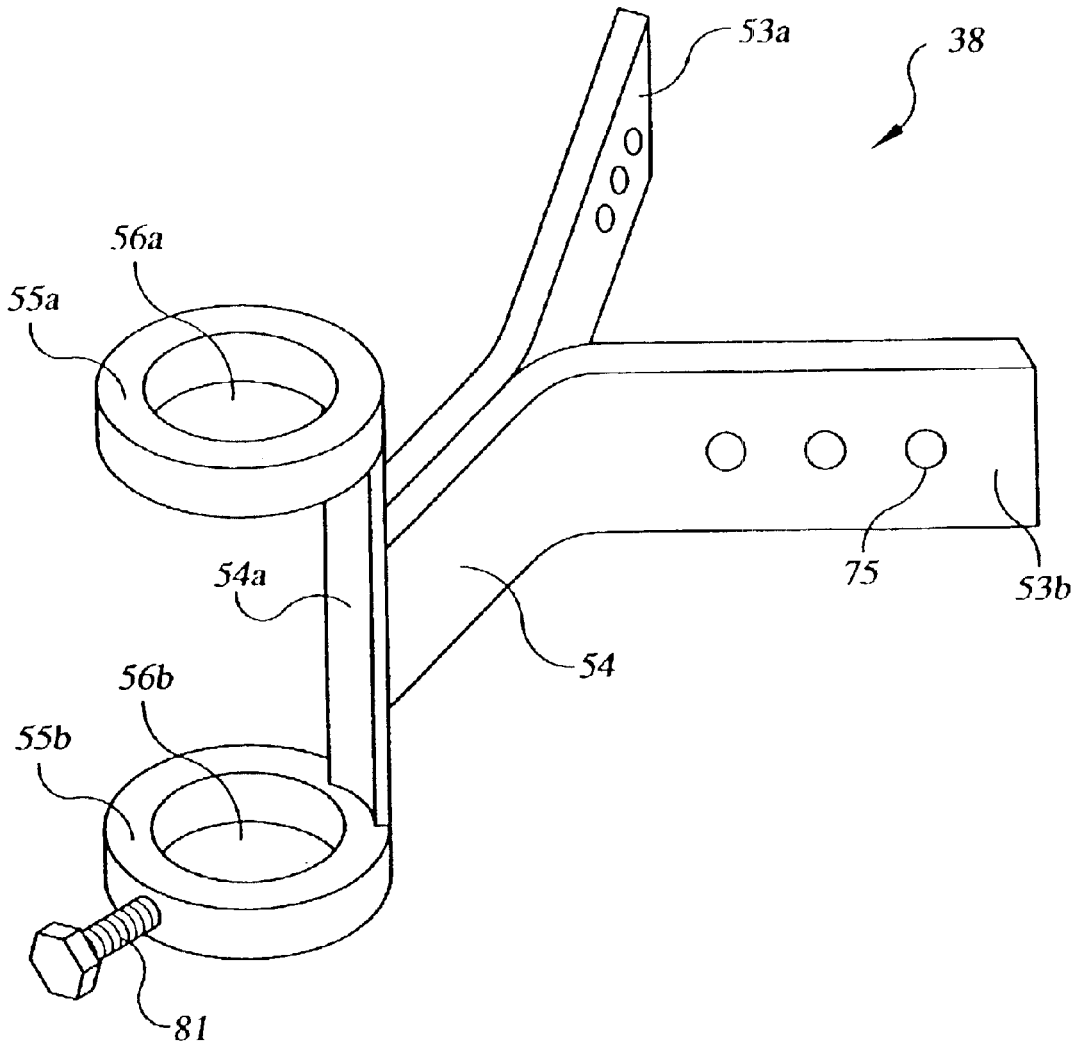
FIG. 8 is a perspective view of a fixed bracket which can be used in the invention.

Referring now to FIG. 8, another bracket that may be used in the invention is a fixed bracket shown generally as 38. The bracket has transverse arms 53*a* and 53*b*, an outward extending shoulder 54 having an elongated vertically spaced member 54*a* connected to bracket railing holding members 55*a* and 55*b* which have axially aligned openings 56*a* and 56*b* therein to accommodate the vertical member of the safety railing. Openings 75 are provided to secure the bracket to the capflashing. A set screw 81 is used to secure the railing in the opening.

Figure 9:
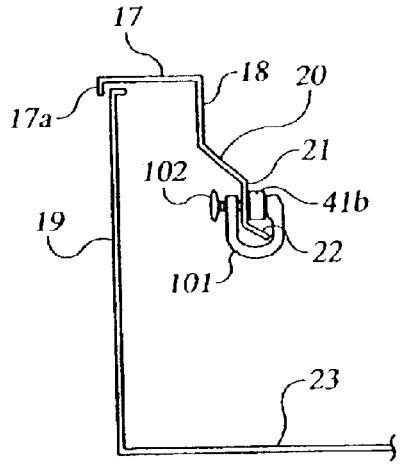
FIG. 9 is a schematic elevational view of a clamp used to secure a pivotable bracket to the capflashing.

Referring to FIG. 9, a schematic elevational view of a capflashing connected to inner wall 19 is shown. The capflashing has a horizontal curb 17 and downward lip 17*a*, an upper vertical outer wall 18, angled flange wall 20, vertical wall 21 and drip edge flashing 22. Referring to FIG. 7D a swivel bracket member 37 may be secured to vertical member 21 of the capflashing by a clamp 101 which extends from the surface of arm 41*b* of the swivel bracket to the inner wall of vertical wall 21 and is secured to wall 21 by a thumb screw 102. The thumb screw 102 may also be at the other end of clamp 101. This provides a method for securing the swivel bracket to the capflashing without any penetration of the roof scuttle structure.

Figure 10A:
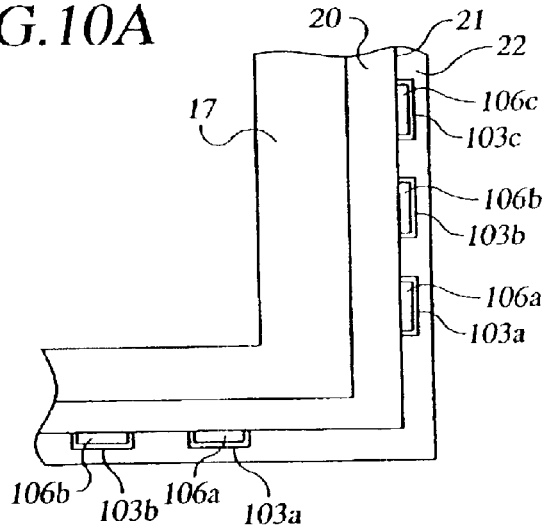
FIG. 10A is a plan view of a capflashing showing brackets on the capflashing used to secure a pivotable bracket to the capflashing.
Figure 10B:
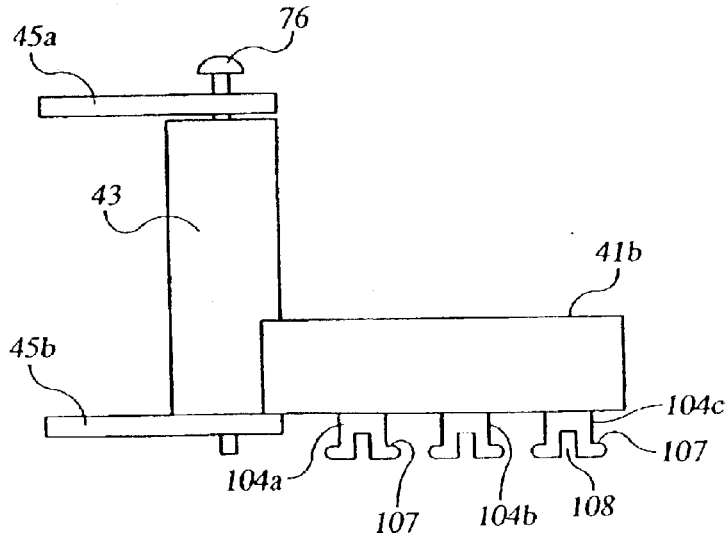
FIG. 10B is an elevational view of a pivotable bracket of the invention for use with the capflashing of FIG. 10A.

Referring now to FIGS. 10A and 10B, a plan view of a capflashing which has been modified by welding or otherwise securing flanges to the capflashing is shown. Thus, in FIG. 10A, flanges 103*a*, 103*b* and 103*c* are welded to vertical member 21 and have respective openings 106*a*, 106*b* and 106*c*. The swivel bracket of FIG. 7D is shown modified by having legs 104*a*, 104*b* and 104*c* extending downward from the lower surface of arm 41*b*. Legs 104*a*, 104*b*, and 104*c* are shown having outward nubs 107 and openings 108 which when the legs are inserted into their respective openings 106*a*, 106*b* and 106*c*, will snap into the openings and be held securely in the openings, thus securing the swivel bracket to the capflashing.

Figure 11:
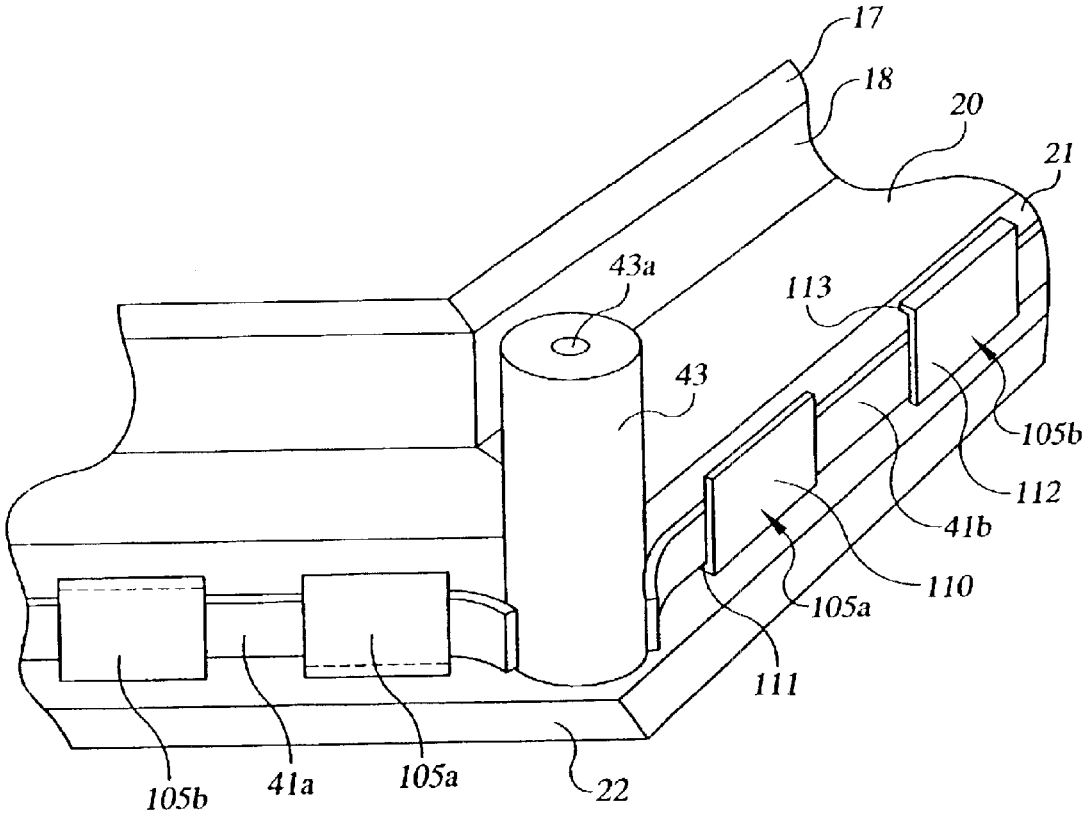
FIG. 11 is a perspective view of a capflashing containing brackets to hold and secure a pivotable bracket of the invention to the capflashing.

Referring now to FIG. 11, a perspective view is shown of a capflashing which has been modified by securing flanges 105*a* and 105*b* to vertical member 21 of the capflashing by welding or other means. Flange 105*a* comprises a body portion 110 and an extending leg 111 at its base and is open at its upper end. Flange 105*b* comprises body portion 112 and extending leg 113 and is open at its lower end. The swivel bracket of FIG. 7A is shown secured in flange members 105*a* and 105*b* and is secured to vertical member 21 of the capflashing. Thus, arms 41*a* and 41*b* of the swivel brackets extend through the openings in the flanges 105*a* and 105*b* and are held securely to the vertical member 21 of the capflashing. This likewise avoids penetration of the roof scuttle structure.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A roof scuttle and safety railing system for enclosing a roof opening comprising:

rectangular roof scuttle having a vertical curb extending upward from the roof surface and extending around the periphery of an opening in the roof, the vertical curb having front, rear and opposed sides, a door hinged to the scuttle for moving to an open or closed position and a capflashing on the top of the curb which has a horizontal member extending outward from the curb and at least one vertical member extending downward from said horizontal member toward the roof surface, the capflashing extending around the periphery of the curb;

four brackets secured to the vertical member of the capflashing with each bracket proximate each corner of the scuttle, each of said brackets extending outward relative to the vertical member with at least two of said brackets being pivotable laterally about a vertical axis and each of said brackets having at least one bracket opening; and one or more safety railings, each railing having a first vertical member and a second vertical member and one or more horizontal connected cross members running between the first and second vertical members with each vertical member being held and secured in a respective one of said bracket opening.

2. The roof scuttle and safety railing system of claim 1 wherein there is a space between an outside wall of the curb and an inside wall of the capflashing vertical member.

3. The roof scuttle and safety railing system of claim 1 wherein each of the pivotable brackets include a vertically disposed pivot pin plug spaced away from the vertical member of the capflashing and one or more arms pivotally mounted to said pivot pin plug with each arm having said at least one bracket opening for holding and securing said first or second vertical member of the safety railing.

4. The roof scuttle and safety railing system of claim 1 wherein all the brackets are pivotable.

5. The roof scuttle and safety railing system of claim 1 wherein a gate is hingedly connected at a front side of the roof scuttle to one of the safety railing vertical members for movement to and away from the roof opening.

6. The roof scuttle and safety railing system of claim 1 wherein a clamp is used to hold the bracket to the capflashing.

7. A method for installing a safety railing on a new or existing roof scuttle used to cover a roof opening comprising the steps of:

providing a roof scuttle surrounding a roof opening, which scuttle has a vertical curb extending upward from the roof surface and extending around the periphery of the opening in the roof, the vertical curb having front, rear and opposed sides and the scuttle is weather proofed and installed on the roof, the roof scuttle having a capflashing on the top of the curb having a horizontal member extending outward from the curb and at least one vertical member extending downward from said horizontal member toward the roof surface, the capflashing extending around the periphery of the curb;

securing four brackets to the vertical member of the capflashing with each bracket proximate each corner of the scuttle, each of said brackets extending outward relative to the vertical member with at least two of said brackets being pivotable laterally about a vertical axis and each of said brackets having at least one bracket opening a second vertical member of the safety railing;

providing one or more safety railings each railing comprising a first vertical member and a spaced apart second vertical member and one or more horizontal connecting cross members; and inserting the first and second vertical members of each safety railing into a respective one of said bracket openings.

8. The method of claim 7 wherein there is a space between an outside wall of the curb and an inside wall of the vertical member.

9. The method of claim 7 wherein all the brackets are pivotable.

10. The method of claim 7 wherein a gate is hingedly connected at a front side of the roof scuttle to one of the safety railing vertical members for movement to and away from the roof opening.

11. The method of claim 7 wherein each of the pivotable brackets includes a vertically disposed pivot pin plug spaced away from the vertical and one or more arms pivotally mounted to said pivot pin plug with each arm having said at least one vertically spaced opening.

12. The method of claim 7 wherein a clamp is used to hold the bracket to the capflashing.

* * * * *

UNITED STATES PATENT AND TRADEMARK OFFICE

CERTIFICATE OF CORRECTION

PATENT NO. : 6,931,793 B2
DATED : August 23, 2005
INVENTOR(S) : Joyce et al.

It is certified that error appears in the above-identified patent and that said Letters Patent is hereby corrected as shown below:

Column 6,
Line 9, delete "Figs. 1-8" and substitute therefor -- Figs. 1-11 --.

Column 10,
Line 38, delete "a second vertical member of the safety railing".
Line 58, after "vertical" insert -- member --.

Signed and Sealed this

Twenty-second Day of November, 2005

JON W. DUDAS
*Director of the United States Patent and Trademark Office*